US005888716A

United States Patent [19]

Edwards et al.

[11] Patent Number: 5,888,716

[45] **Date of Patent: *Mar. 30, 1999**

[54] PHOTOGRAPHIC ELEMENT CONTAINING IMPROVED COUPLER SET

[75] Inventors: James Lawrence Edwards; Philip T. S. Lau; Stanley Wray Cowan, all of Rochester, N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 699,904

[22] Filed: Aug. 20, 1996

[51] Int. Cl.[6] ..... G03C 1/08; G03C 7/26; G03C 7/32

[52] U.S. Cl. ..... 430/549; 430/502; 430/503; 430/543; 430/552; 430/553; 430/557; 430/558; 430/505

[58] Field of Search ..... 430/502, 503, 430/505, 543, 549, 552, 553, 558, 557

[56] References Cited

U.S. PATENT DOCUMENTS

| | | | |
|---|---|---|---|
| 4,609,619 | 9/1986 | Katoh et al. | 430/553 |
| 4,775,616 | 10/1988 | Kilminster et al. | 430/552 |
| 4,849,328 | 7/1989 | Hoke et al. | 430/553 |
| 4,968,594 | 11/1990 | Shimazaki et al. | 430/549 |
| 5,008,180 | 4/1991 | Merkel et al. | 430/552 |
| 5,021,555 | 6/1991 | Szajewski et al. | 430/544 |
| 5,045,442 | 9/1991 | Hoke | 430/553 |
| 5,183,729 | 2/1993 | Naito et al. | 430/385 |
| 5,429,915 | 7/1995 | Shibahara et al. | 430/506 |
| 5,597,679 | 1/1997 | Yoshioka | 430/503 |

FOREIGN PATENT DOCUMENTS

| | | |
|---|---|---|
| 0242013 A | 10/1987 | European Pat. Off. . |
| 0503587 A | 9/1992 | European Pat. Off. . |
| 59-111645 | 6/1984 | Japan . |
| 1253742 | 10/1989 | Japan . |
| 2035450 | 2/1990 | Japan . |
| 4163448 | 6/1991 | Japan . |

*Primary Examiner*—Geraldine Letscher
*Attorney, Agent, or Firm*—Arthur E. Kluegel

[57] ABSTRACT

The invention provides a photographic element comprising a red light sensitive silver halide emulsion layer having associated therewith a cyan dye forming coupler having Formula (I) and a green light sensitive silver halide emulsion layer having associated therewith a magenta dye forming coupler having formula IIA or IIB:

I

IIA

IIB wherein the substituents are as defined herein.

24 Claims, No Drawings

PHOTOGRAPHIC ELEMENT CONTAINING IMPROVED COUPLER SET

FIELD OF THE INVENTION

The present invention relates to a silver halide photographic element having improved color reproduction and particularly to direct viewing color photographic recording materials containing particular classes of cyan and magenta couplers, the combination of which provides uniquely high color purities and a substantially larger dye gamut than known color photographic materials.

BACKGROUND OF THE INVENTION

A typical photographic element contains multiple layers of light sensitive photographic silver halide emulsions with one or more of these layers being spectrally sensitized to each of blue light, green light and red light. In the conventional subtractive color system, the blue, green and red light sensitive layers typically contain yellow, magenta and cyan dye forming couplers, respectively.

To form color photographic images, the color photographic material is exposed imagewise and processed in a color developer bath containing an aromatic primary amine color developing agent. Image dyes are formed by the coupling reaction of these couplers with the oxidized product of the color developing agent.

It has been an ongoing object of photographic researchers efforts for many years to develop and combine cyan, magenta and yellow image dyes of different chemical structures in order to improve the range of colors produced and hence increase the dye color gamut.

Direct viewing color print materials such as color papers, motion picture print films or color reversal slide films rely on the formation of color metamers within the photographic element to reproduce the color of an image. The color image is formed by generating a combination of cyan, magenta and yellow dyes in proportion to the amounts of exposure of red green and blue light respectively onto the element with the object being for the reproduced image to duplicate as nearly as possible the stimulation of the optic sensors of the eye resulting from the original image.

Thus, any color in the original scene is reproduced as a unique combination of the cyan, magenta and yellow image dyes in the viewed print material. The absolute relationship of the original color to the reproduced color is a combination of many factors. It is however, limited by the dye gamut achievable by the multitude of combinations of cyan, magenta and yellow dyes used to generate the final image. Dye gamut is a measure of the breadth of colors capable of being reproduced by the combination of dyes used to make the image.

Dye gamut is limited by many features of an imaging system. For example, dye gamut is limited by the minimum and maximum densities achievable by the photographic element, by the color purity of the individual dyes, etc. Color purity of a dye is a function of the secondary absorption of the dye, the shape of the absorption band of the dye, and its bandwidth. In addition to the individual dye characeristics, to achieve the highest color gamut it is necessary to have cyan, magenta and yellow image dyes which have the preferred absorption maxima relative to one another, narrow bandwidth (to increase color purity) and absorption band shapes which function together to provide a maximum dye gamut.

In the measurement of color, or colorimetry, the calorimetric term chroma (C*) is a measure of the color saturation or color purity (sometimes referred to as 'brilliance'). Since C* changes as a function of its lightness (L*) it is necessary to specify L* when comparing C* measurements between different examples. In order to measure C*, it is first necessary to specify the illuminant under which the subject is to be measured or viewed. It is convenient to specify a color temperature rather than a specific light source such as daylight, tungsten or fluorescent. For daylight viewing, a color temperature of 5000° K. is representative of a typical daylight illuminant.

Chroma itself does not imply a given color or dye hue, but rather is a measure of the purity of a given color. As such, a value for C* is first obtained by measuring two other colorimetric terms, a* and b*. These metrics, when specified in combination, describe the color of an object, whether it be red, green, blue, etc. The measurement of a* and b* is well documented and now represents an international standard of color measurement. (The well known CIE system of color measurement was established by the International Commission on Illumination in 1931 and was further revised in 1971. For a more complete description of color measurement refer to "Principles of Color Technology, 2nd Edition by F. Billmeyer, Jr. and M. Saltzman, published by J. Wiley and Sons, 1981.)

Simply stated, a* is a measure of how green or magenta the color is (since they are color opposites) and b* is a measure of how blue or yellow a color is. From a mathematical perspective, a* and b* are determined as follows:

$$a^*=500\{(X/X_n)^{1/3}-(Y/Y_n)^{1/3}\}$$

$$b^*=200\{(Y/Y_n)^{1/3}-(Z/Z_n)^{1/3}\}$$

Where X, Y and Z are the tristimulus values obtained from the combination of the visible reflectance spectrum of the object, the illuminant source (i.e. 5000° K.) and the standard observer function.

Once a* and b* are obtained, the value of C* may be obtained by the following equation:

$$C^*=(a^{*2}+b^{*2})^{1/2}$$

Thus in a photographic element, as dye formation increases as a function of increasing exposure, the density of the element increases. Since L* is a measurement of lightness or darkness it changes in concert with density. Since an L* of 100 is perfectly white, there is no color. Correspondingly, an L* of 0, is perfectly black and again, there is no color. Therefore color only exists if L* has a value greater than 0 and less than 100.

The value of L* is a function of the tristimulus value Y, thus $$L^*=116(Y/Y_n)^{1/3}-16$$

As exposure increases on a photographic element and dye density also increases in proportion due to color development, L* decreases. C*, however, increases with exposure to a maximum value. This maximum value is a function of many variables, but is generally bounded by the Dmin and Dmax of an element and the color purity of the dye being formed.

Magenta dyes absorb green light and typically have absorption maxima near the center of the green region, or about 550 nm. The most commonly used magenta couplers are those of the pyrazolone type. The image dyes derived from these couplers have several deficiencies, including an absorption spectra having too much unwanted absorption of blue and red light which limits the gamut of the colors obtainable using this type of coupler.

In recent years, magenta couplers have been developed based on pyrazolotriazole compounds. Compared to the pyrazolone based magenta couplers, the pyrazolotriazole couplers have been shown to have significantly lower unwanted absorption of blue and red light and to have a narrower dye adsorption bandwidth. The pyrazolotriazole couplers have also been shown to be excellent for light and dark image stability when compared to the pyrazolones.

Yellow dyes absorb blue light and typically have absorption maxima of about 450 nm. The precise location of the peak absorption depends upon several other factors including the shape of its absorption band, its bandwidth and the shapes and positions of the absorption bands of the cyan and magenta dyes with which it is associated. Couplers used to form the yellow dyes in direct viewing color print materials are usually based upon acylacetanilides and most typically, alkylacylacetanilides. Benzoylacetanilides are known to have absorption bands which absorb more green light than the alkylacetanilides and therefore are not preferred in direct viewing photographic systems.

Alkylacylacetanilide couplers in which the acetanilide ring is substituted with an alkoxy group in the ortho position of the anilide ring are known to produce yellow image dyes which have an absorption maxima at shorter wavelengths than those couplers which have a halogen (i.e. Cl) or other substituent. Shifting the absorption band to shorter wavelengths increases the color saturation and resultant color purity of the dye by reducing the unwanted absorption of green light. This is therefore a preferred embodiment. A preferred subclass of these yellow couplers is a cycloalkylacylacetanilide compound. The image dyes produced from these couplers have absorption maxima at shorter wavelengths with sharp cutting bands on their long wavelength sides also resulting in higher color purity.

Cyan dyes absorb red light and typically have an absorption maximum of about 650 nm. Traditionally, the cyan dyes used in color papers have had nearly symmetrical absorption bands. Such dyes have rather large amounts of unwanted absorption in the green and blue regions of the spectrum. Much effort has gone into the design of the cyan dye forming coupler used in concert with the magenta and yellow couplers described above.

Couplers used to form cyan image dyes are generally derived from naphthols and phenols, as described, for example, in U.S. Pat. Nos. 2,367,351, 2,423,730, 2,474,293, 2,772,161, 2,772,162, 2,895,826, 2,920,961, 3,002,836, 3,466,622, 3,476,563, 3,552,962, 3,758,308, 3,779,763, 3,839,044, 3,880,661, 3,998,642, 4,333,999, 4,990,436, 4,960,685, and 5,476,757; in French patents 1,478,188 and 1,479, 043; and in British patent 2,070,000.

From an historic perspective, the most common cyan couplers used in color papers are phenolic couplers (Formula 1), wherein $R_1$ is an alkyl or aryl group, most often an alkyl group substituted at the alpha position by an aryloxy group; $R_2$ is an alkyl group, usually methyl or ethyl; X is a halogen atom; and Z is a halogen atom or a coupling-off group, usually halogen.

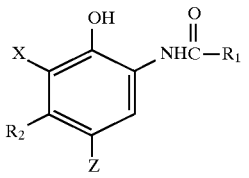

(1)

These couplers of the phenolic class are most prevalent in modern direct viewing photographic systems as they combine the advantages of ease of synthesis, reasonable cost, good light and dark image stability and a dye absorption band which is adequate to obtain a satisfactory color dye gamut. Nevertheless, these dye properties leave room for improvement. Furthermore, these dyes have a tendency to be bleached by reaction with ferrous ions that are present in the the bleaching solution of the color development process.

Cyan couplers that have been proposed to overcome some of these problems are 2,5-diacylaminophenols containing a sulfone, sulfonamido or sulfate moiety in the ballasts at the 5-position (not the 2-position), as disclosed in U.S. Pat. Nos. 4,609,619, 4,775,616, 4,849,328, 5,008,180, 5,045,442, and 5,183,729; and Japanese patent applications JP02035450 A2, JP01253742 A2, JP04163448 A2, JP04212152 A2, and JP05204110 A2. Even though cyan image dyes formed from these couplers show improved stability to heat and humidity, enhanced optical density and resistance to reduction by ferrous ions in the bleach bath, the dye absorption maxima ($\lambda$max) are too bathochromically shifted (that is, shifted to the red end of the visible spectrum) and the absorption spectra are too broad. Thus, these couplers are not practical for use in color papers or other direct color print viewing systems.

Although the use of sulfone (—$SO_2$—) groups in the ballast moieties of phenolic cyan couplers has been described in various publications cited above, the coupler structures disclosed do not result in the desired improved color reproduction and color saturation in color photographic papers.

There have been numerous attempts to improve the dye gamut of direct viewing photographic imaging materials. Bowne, U.S. Pat No. 4,960,685, discusses the advantages of combining certain naphtholic cyan couplers with specified magenta and yellow dyes. The cyan dye forming couplers of those inventions usually have poor solubility in organic solvents and are difficult to disperse in gelatin. Furthermore, the cyan dyes derived from them exhibit hue shifts as a function of increasing image density. They have not, therefore found any practical application.

It is a problem to be solved to provide a photographic element, especially one for direct viewing, which produces colors of greater color saturation and which exhibits an increased color gamut compared to elements heretofore available.

SUMMARY OF THE INVENTION

The invention provides a photographic element comprising a red light sensitive silver halide emulsion layer having associated therewith a cyan dye forming coupler having Formula (I) and a green light sensitive silver halide emulsion layer having associated therewith a magenta dye forming coupler having formula IIA or IIB:

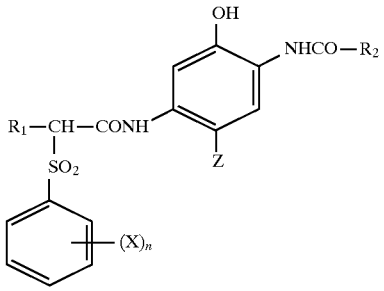

I wherein $R_1$ represents hydrogen or an alkyl group;

$R_2$ represents an alkyl group or an aryl group;

n represents 1, 2, or 3;

each X is located at a position of the phenyl ring meta or para to the sulfonyl group and is independently selected from the group consisting of alkyl, alkenyl, alkoxy, aryloxy, acyloxy, acylamino, sulfonyloxy, sulfamoylamino, sulfonamido, ureido, oxycarbonyl, oxycarbonylamino, and carbamoyl groups; and Z represents a hydrogen atom or a group which can be split off by the reaction of the coupler with an oxidized color developing agent; and

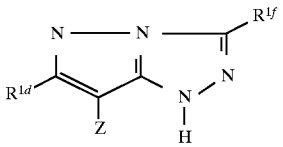

IIA

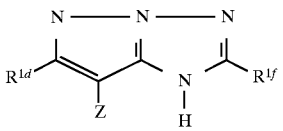

IIB wherein Z represents hydrogen or a coupling-off group bonded to the coupling site; and $R^{1d}$ and $R^{1f}$ represent a hydrogen atom, or a substituent group.

A photograpic element in accordance with the invention provides colors of greater color saturation and an increased color gamut than elements heretofore available. It also provides a color photographic image which has excellent image stability when stored in light or dark or high temperature and humidity conditions.

DETAILED DESCRIPTION OF THE INVENTION

The photographic element of the invention comprises a light sensitive silver halide emulsion layer having associated therewith a cyan dye forming coupler having Formula (I):

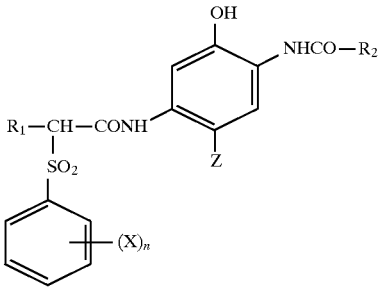

I wherein $R_1$ represents hydrogen or an alkyl group;

$R_2$ represents an alkyl group or an aryl group;

n represents 1, 2, or 3;

each X is located at a position of the phenyl ring meta or para to the sulfonyl group and is independently selected from the group consisting of alkyl, alkenyl, alkoxy, aryloxy, acyloxy, acylamino, sulfonyloxy, sulfamoylamino, sulfonamido, ureido, oxycarbonyl, oxycarbonylamino, and carbamoyl groups; and Z represents a hydrogen atom or a group which can be split off by the reaction of the coupler with an oxidized color developing agent.

The cyan coupler of the invention is a 2,5-diacylaminophenol cyan coupler in which the 5-acylamino moiety is an amide of a carboxylic acid which is substituted in the alpha position by a particular sulfone (—$SO_2$—) group. The sulfone moiety is an arylsulfone and is substituted only at the meta or para position of the aryl ring. In addition, the 2-acylamino moiety is an amide (—NHCO—) of a carboxylic acid, and cannot be a ureido (—NHCONH—) group. The result of this unique combination of sulfone-containing amide group at the 5-position and amide group at the 2-position is a class of cyan dye-forming couplers which form H-aggregated image dyes having very sharp-cutting dye hues on the short wavelength side of the absorption curves and absorption maxima (λmax) generally in the range of 620–645 nanometers, which is ideally suited for producing excellent color reproduction and high color saturation in color photographic papers.

Referring to formula (I), $R_1$ represents hydrogen or an alkyl group including linear or branched cyclic or acyclic alkyl group of 1 to 10 carbon atoms, suitably a methyl, ethyl, n-propyl, isopropyl or butyl group, and most suitably an ethyl group.

$R_2$ represents an aryl group or an alkyl group such as a perfluoroalkyl group. Such alkyl groups typically have 1 to 20 carbon atoms, usually 1 to 4 carbon atoms, and include groups such as methyl, propyl and dodecyl,; a perfluoroalkyl group having 1 to 20 carbon atoms, typically 3 to 8 carbon atoms, such as trifluoromethyl or perfluorotetradecyl, heptafluoropropyl or heptadecylfluorooctyl; a substituted or unsubstituted aryl group typically having 6 to 30 carbon atoms, which may be substituted by, for example, 1 to 4 halogen atoms, a cyano group, a carbonyl group, a carbonamido group, a sulfonamido group, a carboxy group, a sulfo group, an alkyl group, an aryl group, an alkoxy group, an aryloxy group, an alkylthio group, an arylthio group, an alkylsulfonyl group or an arylsulfonyl group. Suitably, $R_2$ represents a heptafluoropropyl group, a 4-chlorophenyl group, a 3,4-dichlorophenyl group, a 4-cyanophenyl group, a 3-chloro-4-cyanophenyl group, a pentafluorophenyl group, a 4-carbonamidophenyl group, a 4-sulfonamidophenyl group, or an alkylsulfonylphenyl group.

In formula (I), each X is located at the meta or para position of the phenyl ring, and each independently represents a linear or branched, saturated or unsaturated alkyl or alkenyl group such as methyl, t-butyl, dodecyl, pentadecyl or octadecyl; an alkoxy group such as methoxy, t-butoxy or tetradecyloxy; an aryloxy group such as phenoxy, 4-t-butylphenoxy or 4-dodecylphenoxy; an alkyl or aryl acyloxy group such as acetoxy or dodecanoyloxy; an alkyl or aryl acylamino group such as acetamido, benzamido, or hexadecanamido; an alkyl or aryl sulfonyloxy group such as methylsulfonyloxy, dodecylsulfonyloxy, or 4-methylphenylsulfonyloxy; an alkyl or aryl sulfamoylamino group such as N-butylsulfamoylamino, or N-4-t-butylphenylsulfamoylamino; an alkyl or aryl sulfonamido group such as methanesulfonamido, 4-chlorophenylsulfonamido or hexadecanesulfonamido; a ureido group such as methylureido or phenylureido; an alkoxycarbonyl or aryloxycarbonylamino group such as methoxycarbonylamino or phenoxycarbonylamo; a carbamoyl group such as N-butylcarbamoyl or N-methyl-N-dodecylcarbamoyl; or a perfluoroalkyl group such as trifluoromethyl or heptafluoropropyl. Suitably X represents the above groups having 1 to 30 carbon atoms, more preferably 8 to 20 linear carbon atoms. Most typically, X represents a linear alkyl group of 12 to 18 carbon atoms such as dodecyl, pentadecyl or octadecyl.

"n" represents 1, 2, or 3; if n is 2 or 3, then the substituents X may be the same or different.

Z represents a hydrogen atom or a group which can be split off by the reaction of the coupler with an oxidized color developing agent, known in the photographic art as a "coupling-off group.". The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio, and arylazo. These coupling-off groups are described in the art, for example, in U.S. Pat. Nos. 2,455,169, 3,227,551, 3,432,521, 3,467,563, 3,617,291, 3,880,661, 4,052,212, and 4,134,766; and in U.K. Patent Nos. and published applications 1,466,728, 1,531,927, 1,533,039, 2,066,755A, and 2,017,704A, the disclosures of which are incorporated herein by reference. Halogen, alkoxy and aryloxy groups are most suitable.

Examples of specific coupling-off groups are —Cl, —F, —Br, —SCN, —$OCH_3$, —$OC_6H_5$, —$OCH_2C(=O)NHCH_2CH_2OH$, —$OCH_2C(O)NHCH_2CH_2OCH_3$, —$OCH_2C(O)NHCH_2CH_2OC(=O)OCH_3$, —$P(=O)(OC_2H_5)_2$, —$SCH_2CH_2COOH$,

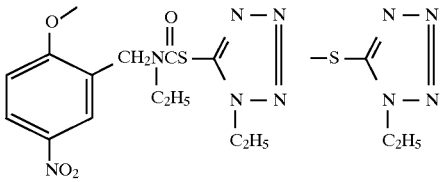

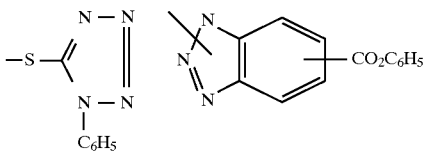

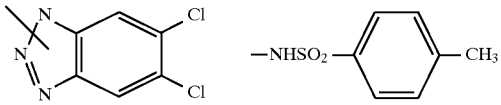

-continued

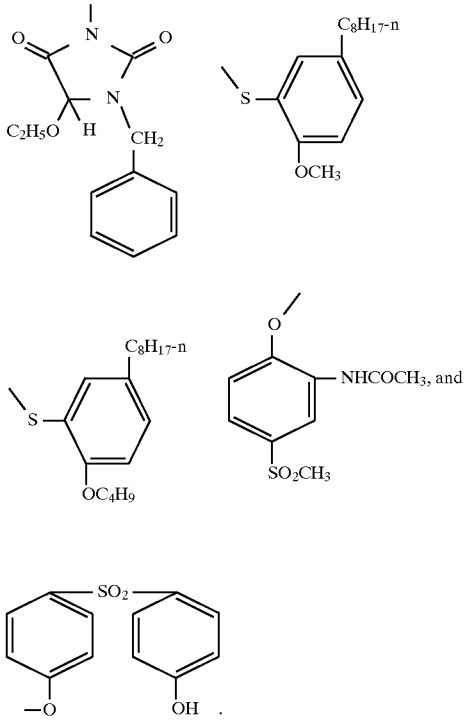

Typically, the coupling-off group is a chlorine atom.

It is essential that the substituent groups $R_1$, $R_2$, X, and Z be selected so as to adequately ballast the coupler and the resulting dye in the organic solvent in which the coupler is dispersed. The ballasting may be accomplished by providing hydrophobic substituent groups in one or more of the substituent groups $R_1$, $R_2$, X, and Z. Generally a ballast group is an organic radical of such size and configuration as to confer on the coupler molecule sufficient bulk and aqueous insolubility as to render the coupler substantially non-diffusible from the layer in which it is coated in a photographic element. Thus the combination of substituent groups $R_1$, $R_2$, X, and Z in formula (I) are suitably chosen to meet these criteria. To be effective, the ballast must contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group. Therefore, in these embodiments the ballast would be primarily located as part of groups $R_2$, X, and Z. Furthermore, even if the coupling-off group Z contains a ballast it is often necessary to ballast the other substituents as well, since Z is eliminated from the molecule upon coupling; thus, the ballast is most advantageously provided as part of groups $R_2$ and X.

The following are examples of inventive cyan couplers:

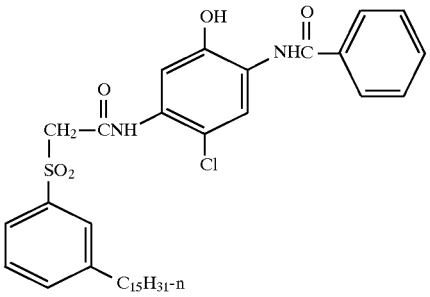
IC-1
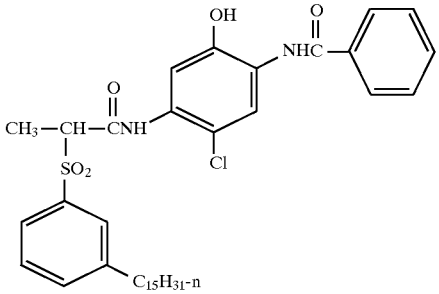
IC-2
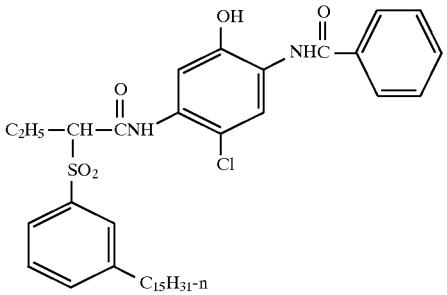
IC-3
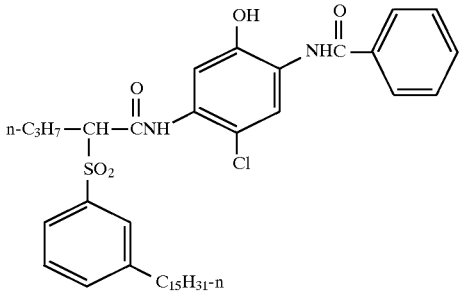
IC-4
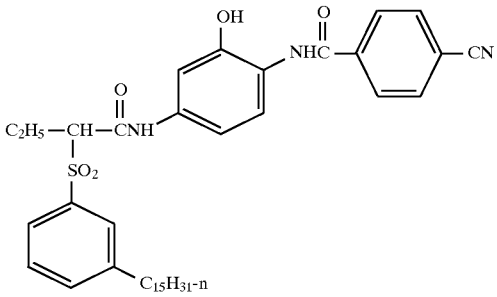
IC-5

-continued
IC-6
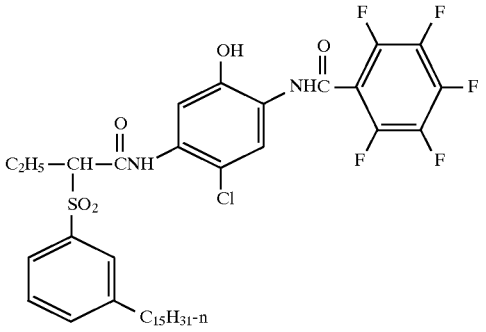
IC-7
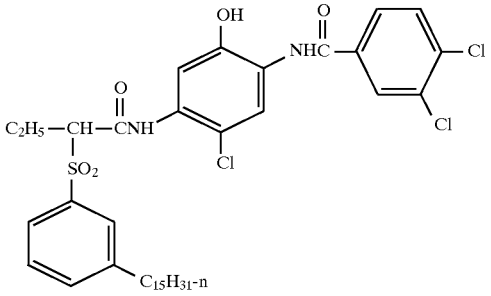
IC-8
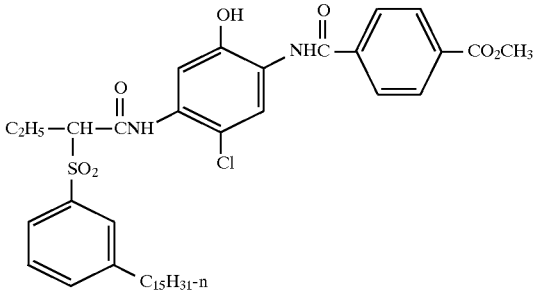
IC-9
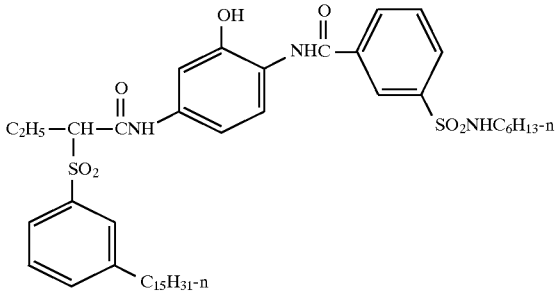
IC-10
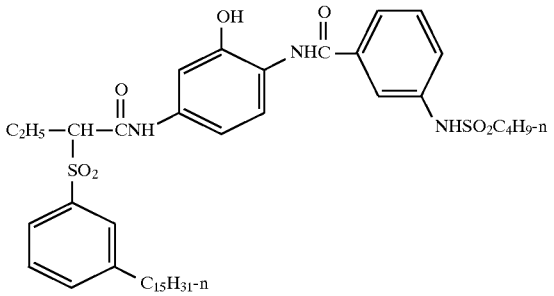

-continued
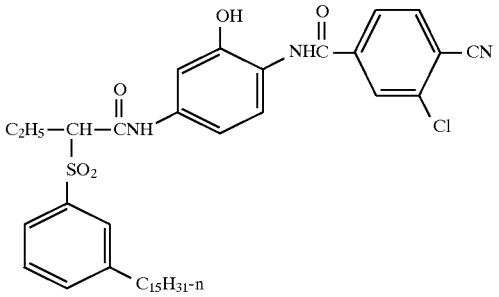
IC-11
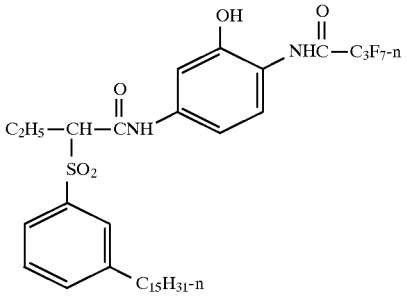
IC-12
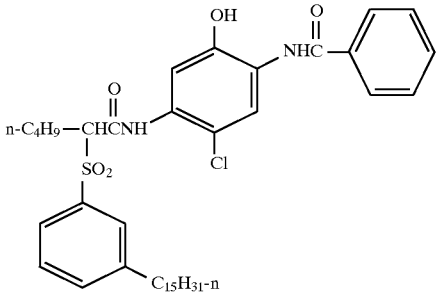
IC-13
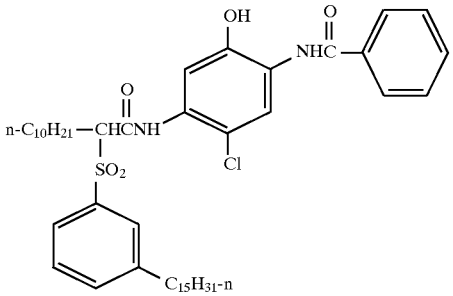
IC-14
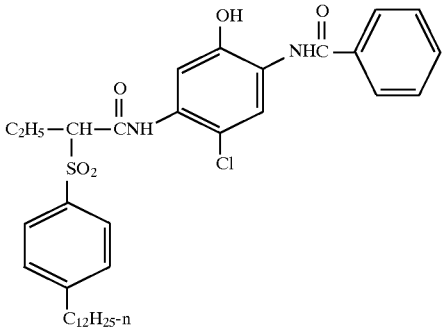
IC-15

-continued
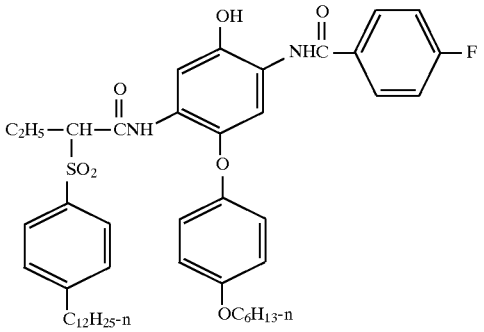
IC-16
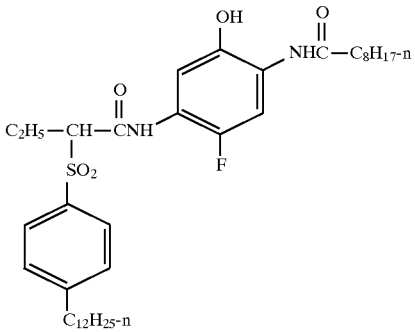
IC-17
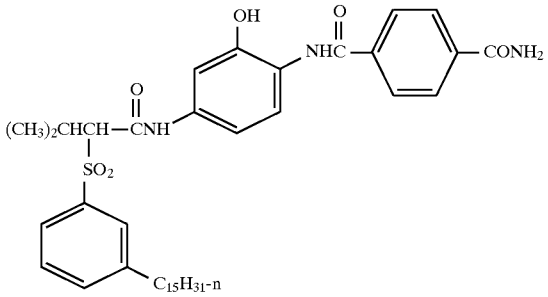
IC-18
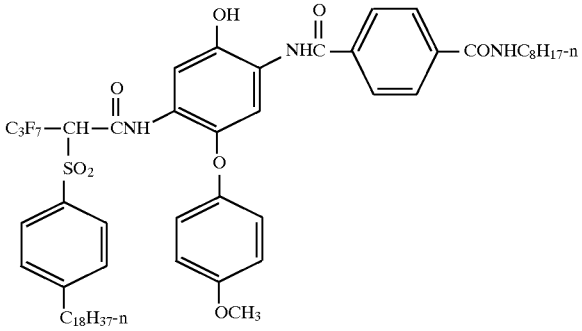
IC-19
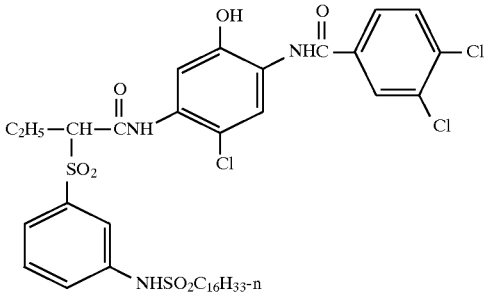
IC-20

-continued
IC-21
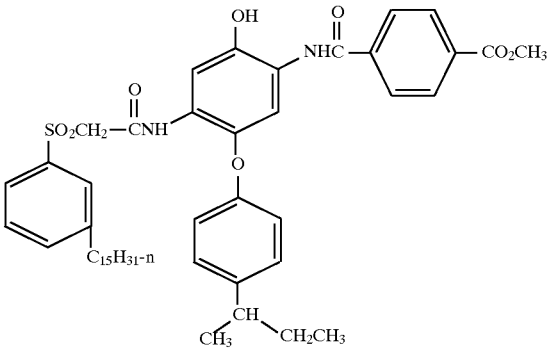
IC-22
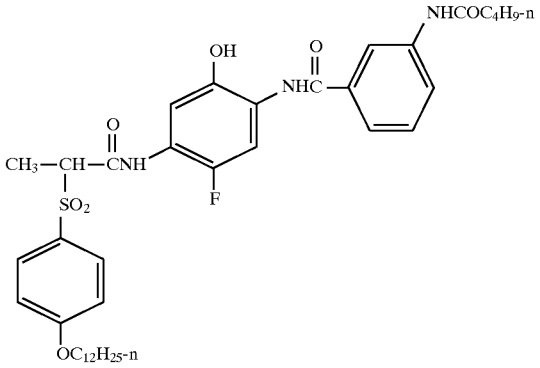
IC-23
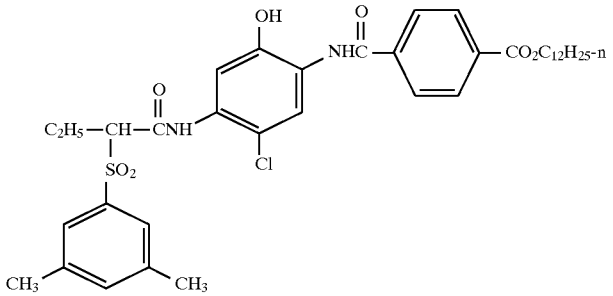
IC-24
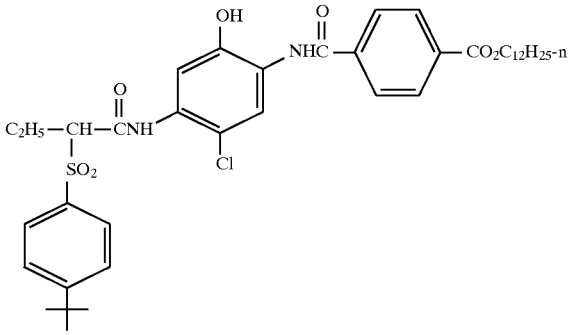

-continued
IC-25
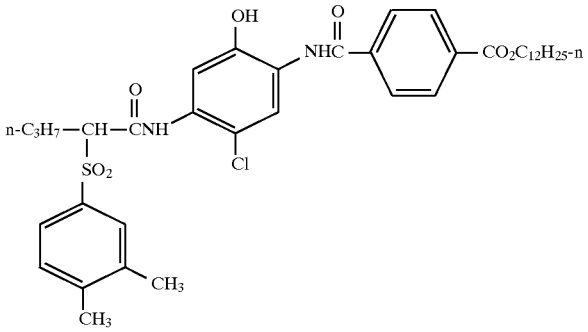
IC-26
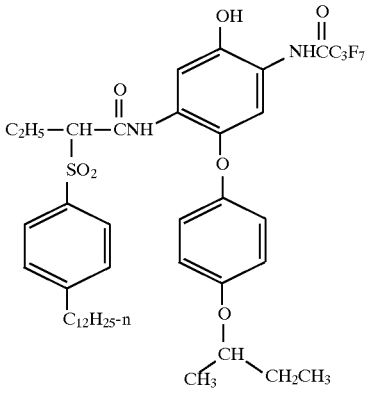
IC-27
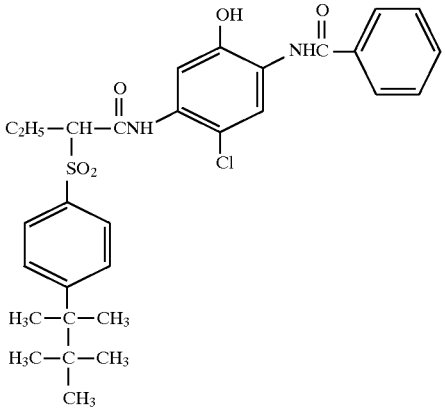
IC-28
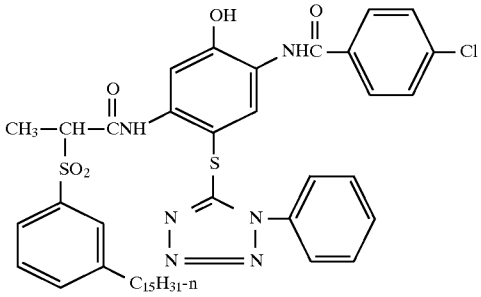

-continued
IC-29
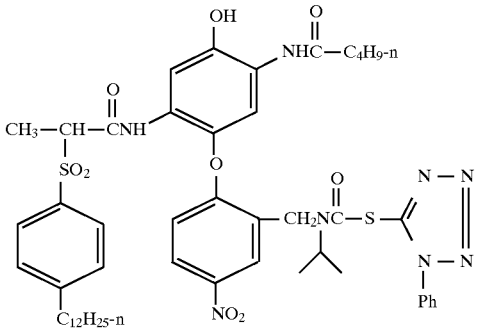
IC-30
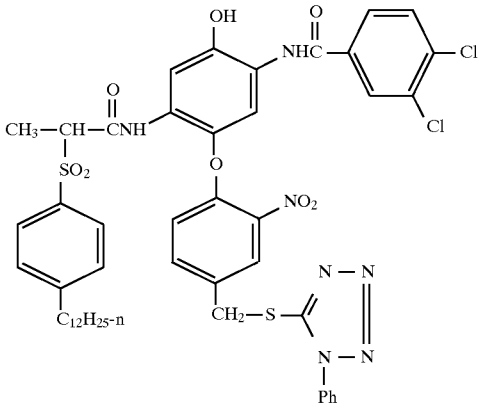
IC-31
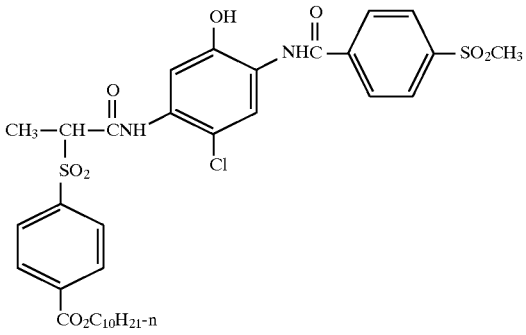
IC-32
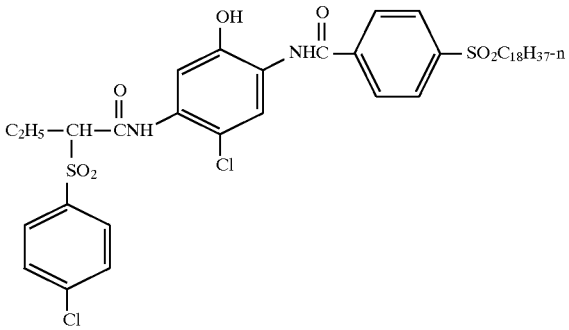

-continued

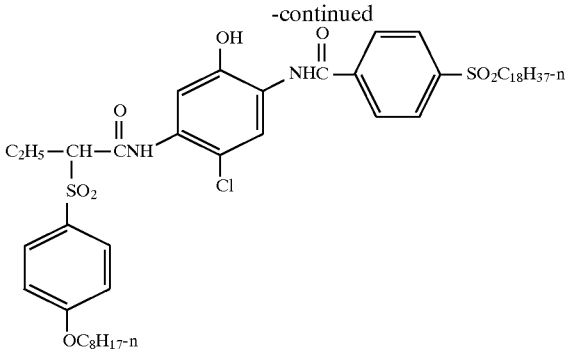

IC-33

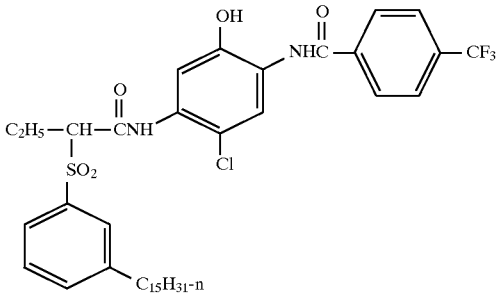

IC-34

The magenta couplers of the invention are represented by the following formulas IIA or IIB.

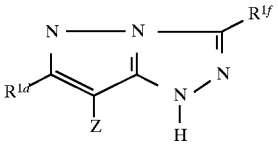

IIA

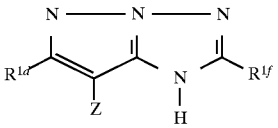

IIB

The yellow couplers most suitable for use in the invention are the acylacetanilide couplers, preferably those having formula III:

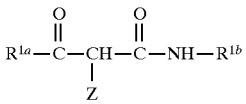

III wherein Z represents hydrogen or a coupling-off group bonded to the coupling site in each of the above formulae. In the above formulae, when $R^{1a}$, $R^{1b}$, $R^{1d}$, or $R^{1f}$ contains a ballast or antidiffusing group, it is selected so that the total number of carbon atoms is at least 8 and preferably at least 10.

$R^{1a}$ represents an aliphatic (including alicyclic) hydrocarbon group, and $R^{1b}$ represents an aryl group.

The aliphatic- or alicyclic hydrocarbon group represented by $R^{1a}$ typically has at most 22 carbon atoms, may be substituted or unsubstituted, and aliphatic hydrocarbon may be straight or branched. Preferred examples of the substituent for these groups represented by $R^{1a}$ are an alkoxy group, an aryloxy group, an amino group, an acylamino group, and a halogen atom. These substituents may be further substituted with at least one of these substituents repeatedly. Useful examples of the groups as $R^{1a}$ include an isopropyl group, an isobutyl group, a tert-butyl group, an isoamyl group, a tert-amyl group, a 1,1-dimethyl-butyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido) isopropyl group, an α-(phthalimido)isopropyl group, an α-(benzenesulfonamido)isopropyl group, and the like.

As an aryl group, (especially a phenyl group), $R^{1b}$ may be substituted. The aryl group (e.g., a phenyl group) may be substituted with substituent groups typically having not more than 32 carbon atoms such as an alkyl group, an alkenyl group, an alkoxy group, an alkoxycarbonyl group, an alkoxycarbonylamino group, an aliphatic- or alicyclic-amido group, an alkylsulfamoyl group, an alkylsulfonamido group, an alkylureido group, an aralkyl group and an alkyl-substituted succinimido group. This phenyl group in the aralkyl group may be further substituted with groups such as an aryloxy group, an aryloxycarbonyl group, an arylcarbamoyl group, an arylamido group, an arylsulfamoyl group, an arylsulfonamido group, and an arylureido group.

The phenyl group represented by $R^{1b}$ may be substituted with an amino group which may be further substituted with a lower alkyl group having from 1 to 6 carbon atoms, a hydroxyl group, —COOM and —$SO_2$M (M=H, an alkali metal atom, $NH_4$), a nitro group, a cyano group, a thiocyano group, or a halogen atom.

In a preferred embodiment, the phenyl group represented by $R^{1b}$ is a phenyl group having in the position ortho to the anilide nitrogen a halogen such as fluorine, chlorine or an alkoxy group such as methoxy, ethoxy, propoxy, butoxy. Alkoxy groups of less than 8 carbon atoms are preferred.

$R^{1b}$ may represent substituents resulting from condensation of a phenyl group with other rings, such as a naphthyl group, a quinolyl group, an isoquinolyl group, a chromanyl group, a coumaranyl group, and a tetrahydronaphthyl group. These substituents may be further substituted repeatedly with at least one of above-described substituents for the phenyl group.

$R^{1d}$ and $R^{1f}$ represent a hydrogen atom, or a substituent group (as defined hereafter in the passage directed to substituents).
Representative examples of magenta and yellow couplers useful in the present invention are as follows:
INVENTIVE MAGENTA COUPLERS
IM-1
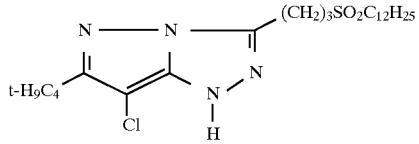
IM-2
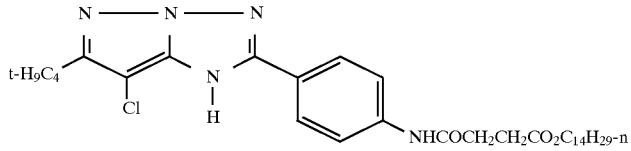
IM-3
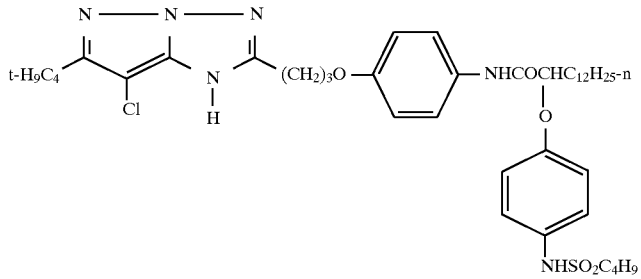
YELLOW COUPLERS
Y-1
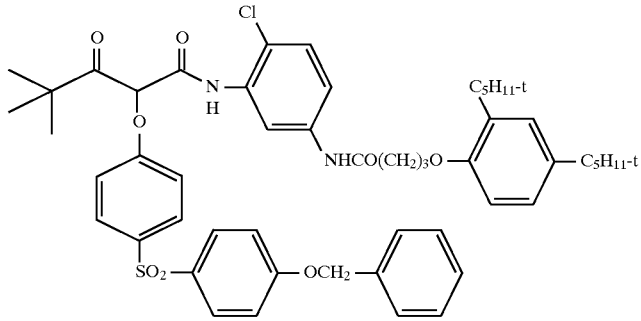
Y-2
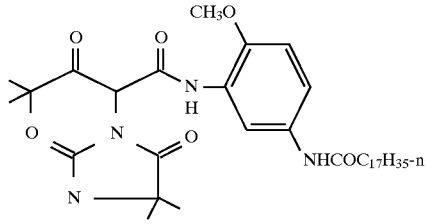
Y-3
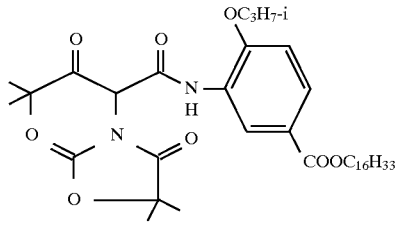

-continued

Y-4

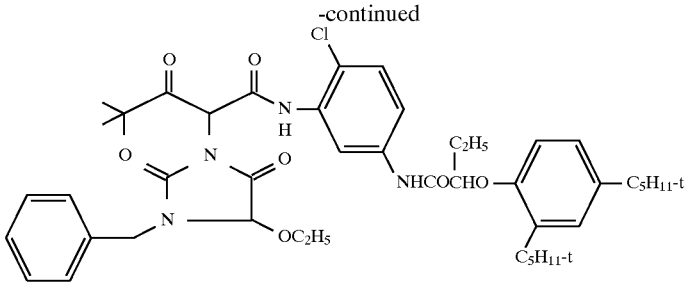

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, avaliable from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing.) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995. Cyan image dye-forming couplers may be included in the element besides the coupler of the invention. These couplers may be located in the same layer as the coupler of the invention or in a different layer.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

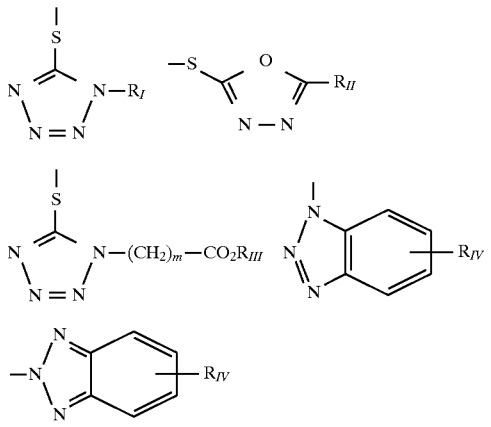

wherein RI is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —COORV and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

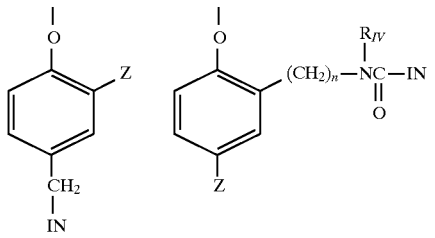

wherein IN is the inhibitor moiety, Z is selected from the group consisting of nitro, cyano, alkylsulfonyl; sulfamoyl ($—SO_2NR_2$); and sulfonamido ($—NRS_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

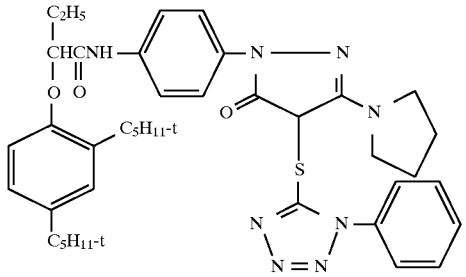

D2

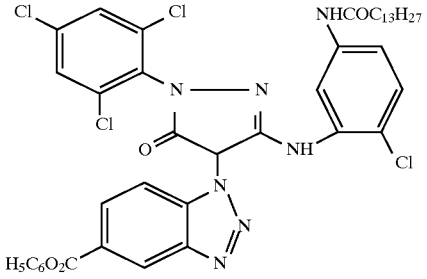

D3

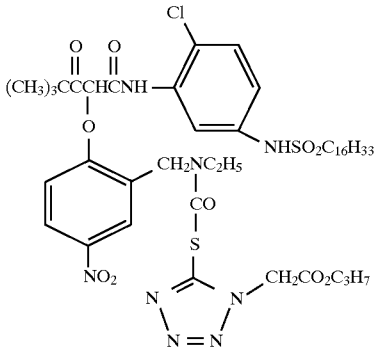

-continued

D4

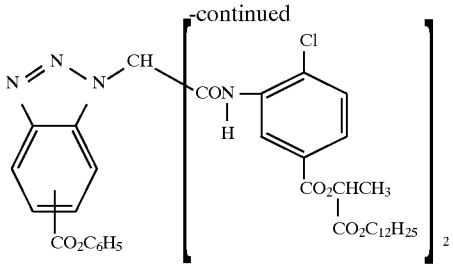

D5

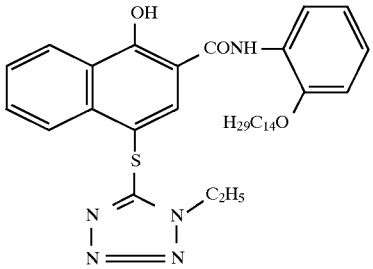

D6

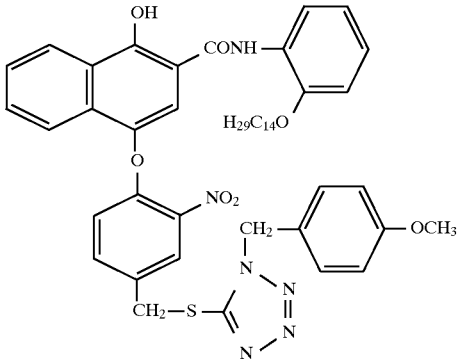

D7

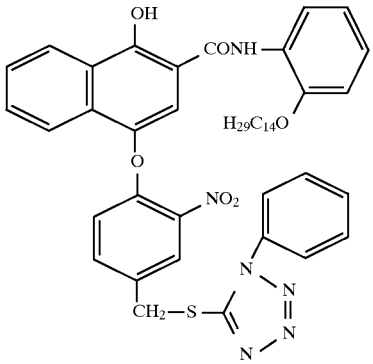

D8

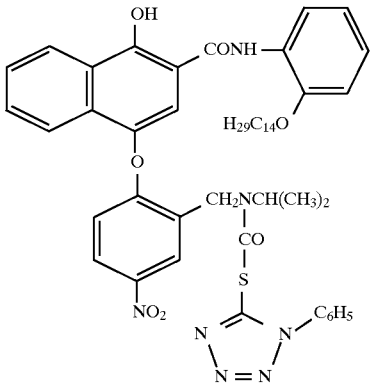

-continued

D9

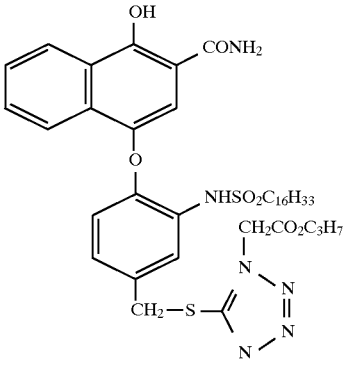

D10

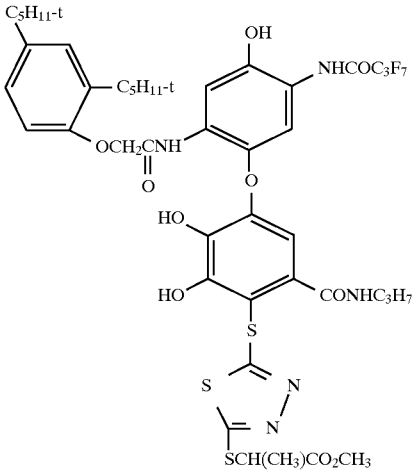

D11

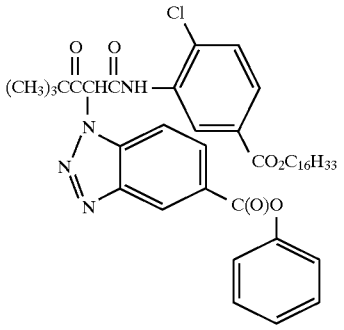

D12

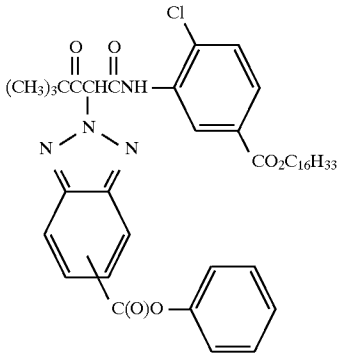

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamido-ethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

SYNTHESIS EXAMPLE

The cyan couplers of this invention can be prepared by reacting alkyl or aryl acid chlorides with an appropriate aminophenol, such as 2-amino-5-nitrophenol or 2-amino-4-chloro-5-nitrophenol to form the 2-carbonamido coupler intermediates. The nitro group of the coupler intermediate can then be reduced and a separately prepared sulfone-containing ballast can be attached thereto by conventional procedures. The synthesis of coupler compound IC-3 will further illustrate the invention.

A. Preparation of the phenolic coupler intermediate

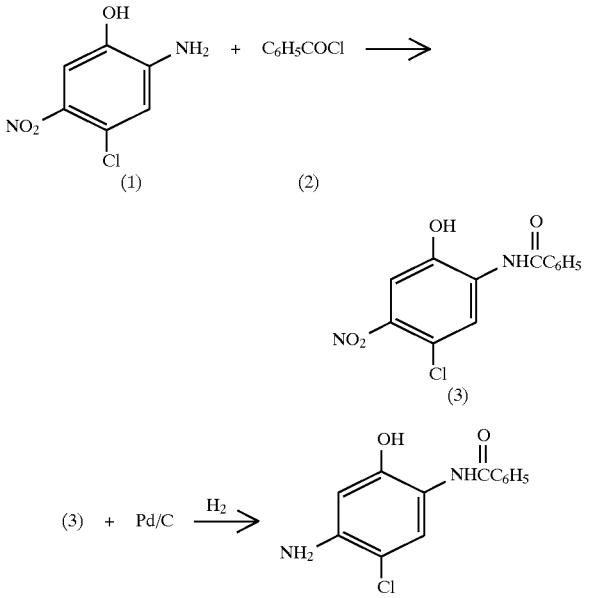

To a stirred solution of 37.7 g (0.20 mol) of 2-amino-4-chloro-5-nitrophenol (1) and 48.5 g (0.40 mol) of N,N-dimethylaniline in 500 ml THF was added 30.9 g (0.22 mol) of benzoyl chloride (2). After stirring for 3 hours at room temperature, the reaction mixture was drowned in ice water and 20 ml concentrated HCl. The solid which precipitated out was collected, washed with water, and recrystallized from $CH_3CN$ to give 54.6 g of the nitro compound (3).

A solution of 8.8 g (0.03 mol) of (3) in 150 ml THF was heated with a teaspoonful of 10% Pd/C and hydrogenated at room temperature under 50 lb per square inch hydrogen pressure for 3 hours. The catalyst was filtered off to give the reduced aminophenol (4) which was stored under a blanket of nitrogen while the sulfone-containing ballast was being prepared.

B. Preparation of the ballast acid chloride

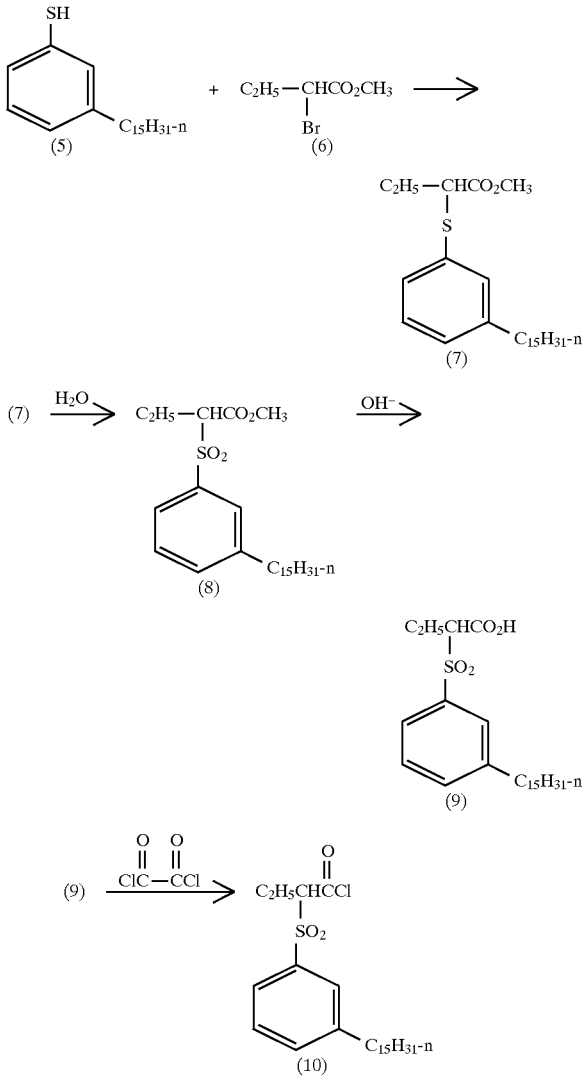

To a well-stirred solution of 40 g (0.13 mol) m-pentadecylphenylthiol (5) and 27 g (0.15 mol) of methyl a-bromobutyrate (6) in 500 ml acetone was added 104 g (0.75 mol) $K_2CO_3$. The mixture was heated on a steam bath and refluxed for 1 hour. After cooling to room temperature the insolubles were filtered off. The filtrate was poured into water and extracted with ethyl acetate. The ethyl acetate was removed under reduced pressure and the residual crude product mixture was dissolved in ligroin. The solution was chromatographed through a short silical gel column, eluting first with ligroin and finally with 50% ligroin-$CH_2Cl_2$ mixture. The fractions containing the pure product were combined and the solvent was removed to give 43 g of (7) as a colorless oil.

The ballast intermediate (7) was taken up in 300 ml acetic acid, cooled to 10–150° C., and treated with 23 ml 30% $H_2O_2$. The mixture was stirred at room temperature for 0.5 hour and then heated on the steam bath for another hour. Upon standing at room temperature overnight the product crystallized out. The pure white solid crystals were collected to give 41.5 g of .(8).

The sulfone ballast ester (8) was dissolved in 200 ml $CH_3OH$ and 200 ml THF. The solution was then heated with 18 g NaOH dissolved in 150 ml water. After stirring at room temperature for 1 hour, the mixture was poured into dilute HCl. The white solid that precipitated out was collected, washed with water and dried to give 40 g of the sulfone ballast acid (IX) as a white solid.

To a solution of 13.6 g (0.031 mol) of (9) in 100 ml $CH_2C_{12}$ was added with stirring 11.4 g (0.09 mol) oxalyl chloride and 5 drops of DMF. After stirring at room temperature for 2 hours, the mixture was concentrated to give 13.9 g of ballast acid chloride (10) as an oil.

C. Preparation of coupler compound IC-3

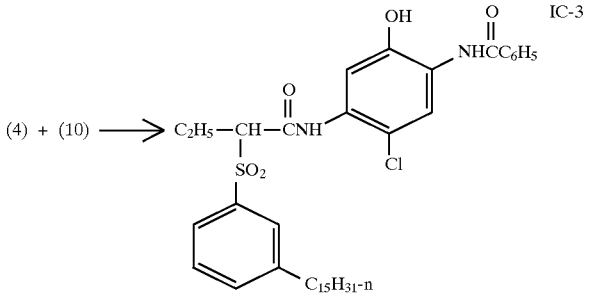

To a stirred solution of 7.9 g (0.03 mol) of the aminophenol (4) in 150 ml THF was added 7.3 g (0.06 mol) of N,N-dimethylaniline and 13.9 g (0.03 mol) of the ballast acid chloride (10). After stirring at room temperature for 2 hours the reaction mixture was poured into water containing 5 ml concentrated HCl. The tan colored solid was collected, washed with water, and recrystallized from $CH_3CN$ to give 17.4 g (85%) of crystalline white solid (IC-3). The structure was confirmed by $H^1$ NMR and elemental analysis.

Calcd. for $C_{38}H_{51}ClN_2O_5S$: C, 66.79; H, 7.52; N, 4.10 Found: C, 66.61; H, 7.56; N, 4.02

PHOTOGRAPHIC EXAMPLES

Multilayer color photographic papers containing couplers of the invention were assembled as follows:

Emulsion preparation

A silver chloride, cubic emulsion identified as CE1, having a grain edge length of 0.38$\mu$ was prepared using conventional double-jet, controlled pAg=7.2, making conditions in the presence of 1,8-dihydroxy-3,6-dithiaoctane at 46° C. The emulsion was washed to remove excess salts and chemically sensitized by heating it to 65° C. in the presence of colloidal gold sulfide.

During the chemical sensitization, an antifoggant, 1-(3-acetamidophenyl-5-mercaptotetrazole) was added in the amount of $1.28\times10^{-3}$ M/Ag-M followed by an aqueous solution of potassium bromide in the amount totaling 1.1 mole percent. After the emulsion was cooled, red sensitizing dye RSD-1 ($3.62\times10^{-5}$ M-dye/Ag-M) was added to complete the sensitization.

A silver chloride, cubic emulsion ME1, having a grain edge length of 0.28$\mu$ was prepared using conventional double-jet, controlled pAg=7.2, making conditions in the presence of 1,8-dihydroxy-3,6-dithiaoctane at 46° C. The emulsion was washed to remove excess salts. A green spectral sensitizing dye GSD-1 was added in the amount of $2.84\times10^{-4}$ M-dye/Ag-M and the emulsion was chemically sensitized by heating it to 70° C. in the presence of colloidal gold sulfide. After chemical sensitization an antifoggant, 1-(3-acetamidophenyl-5-mercaptotetrazole) was added at $1.78\times10^{-3}$ M/Ag-M followed by an aqueous solution of potassium bromide in the amount totaling 0.5 mole percent.

A silver chloride, cubic emulsion YE1, having a grain edge length of 0.75$\mu$ was prepared using conventional double-jet, controlled pAg=7.2, making conditions in the presence of 1,8-dihydroxy-3,6-dithiaoctane at 68° C. The emulsion was washed to remove excess salts and chemically sensitized by heating it to 60° C. in the presence of colloidal gold sulfide.

During the chemical sensitization, a blue sensitizing dye BSD-1 was added in the amount of $3.06\times10^{-4}$ M-dye/Ag-M followed by an antifoggant, 1-(3-acetamidophenyl-5-mercaptotetrazole) was added in the amount $1.00\times10^{-3}$ M/Ag-M followed by an aqueous solution of potassium bromide in the amount totaling 0.6 mole percent which completed the sensitization.

Dispersion Preparation

Oil in water dispersions of each coupler were prepared using conventional dispersing techniques. In general, the coupler (or UV-light absorber), a permanent solvent, required dye stabilizers and an auxiliary solvent (i.e. ethyl acetate) were combined in the appropriate ratios and heated to effect dissoultion. Once obtained, the hot oil phase was mixed with a solution of bone gelatin and Alkanol-XC™ surfactant, then rapidly dispersed using conventional milling techniques.

Multilayer Coating Format

A conventional multilayer color paper coating format such as that described below was prepared for each example.

Silver halide coverages were adjusted so as to maintain the necessary maximum density and contrast requirements of the testing. Couplers were coated in amounts equimolar to those listed in the multilayer coating format below.

TABLE 1

Multilayer Coating Format

| Layer | Material | Coverage (mg/M$^2$) |
|---|---|---|
| Overcoat | Gelatin | 1076. |
| | Bis-vinylsulfonylmethyl ether | 162. |
| | Alkanol-XC ™ | 16. |
| | Stabilizer ST1 | 3. |
| UV-Light | Gelatin | 700. |
| Absorber | UV-1 | 60. |
| Layer | UV-2 | 320. |
| | Solvent S1 | 190. |
| | Stabilizer ST4 | 75. |
| Red Sensitive | Gelatin | 1399. |
| Layer | Cyan coupler | 430. |
| | S1 or S2 | 215. |
| | Stabilizer ST1 | 2. |
| | Emulsion CE1 | 183. |
| UV-Light | Gelatin | 700. |
| Absorber | UV-1 | 60. |
| Layer | UV-2 | 320. |
| | Solvent S1 | 190. |
| | Stabilizer ST1 | 75. |
| Green Sensitive | Gelatin | 1506. |

TABLE 1-continued

Multilayer Coating Format

| Layer | Material | Coverage (mg/M$^2$) |
|---|---|---|
| Layer | Magenta coupler | 430. |
| | Stabilizer ST2 | 184. |
| | Solvent S1 | 215. |
| | Stabilizer ST1 | 43. |
| | Emulsion ME1 | 280. |
| Interlayer | Gelatin | 753. |
| | Alkanol-XC ™ | 10. |
| | Stabilizer ST1 | 86. |
| Blue Sensitive | Gelatin | 1506. |
| Layer | Yellow coupler | 1076. |
| | Solvent S1 | 215. |
| | Emulsion YE1 | 280. |
| Support | Polyethylene coated paper base | |

After the multilayer coating examples were prepared, they were exposed to light in a Kodak Model 1B sensitometer with a color temperature of 3000° K. for 0.1 second. To obtain selected color separations, samples were separately exposed with light filtered though Kodak Wratten™ 29, 98 and 99 tricolor separation filters in order to obtain the desired cyan, magenta and yellow characteristic curves. An exposure scale was produced by combining the paper samples with a stepped 0 to 3 log E neutral exposure tablet having 0.15 log E increments.

Single Layer Coating Format

A conventional single layer coating format was used to perform preliminary evaluations of cyan couplers of the invention. The samples of cyan couplers were dispersed in S-1 and/or solvent S-2 and coated in the format given below:

| Layer | Material | Coverage (mg/M$^2$) |
|---|---|---|
| Overcoat | Gelatin | 1076. |
| | Alkanol XC ™ | 16. |
| | Bis-vinylsulfonylmethyl ether | 118. |
| Emulsion | Gelatin | 1614. |
| | Emulsion CE1 | 183. |
| | Cyan Coupler CC-1 | 430. |
| | Solvent S1 or S2 | 215. |
| Underlayer | Gelatin | 3228. |
| Support | Polyethylene Coated Paper Base | |

The single layer samples were exposed in the same manner as the multilayer samples described below in order to obtain a range of densities from Dmin to Dmax as a function of exposure.

The absorption spectra from each single layer or multilayer sample at a series of increasing densities between Dmin and Dmax was obtained between the wavelength ranges of 400 nm to 800 nm using a commercially available visible spectrophotometer. Next, the unique characteristic spectra of each dye was determined using a computerized regresssion algorithm which reduces the absorption spectrum of each dye as a function of density to a single spectra of the dye which is independent of density. This spectrum, known as the characteristic vector of the dye used to calculate the spectral distribution of the dye at any wavelength and was used in subsequent color modeling determinations.

Using the characteristic absorption spectra above, the dye gamut was determined by specifying and varying the amounts of cyan, magenta and yellow dyes to be combined and determining the resultant values of a*, b*, L* and C* using the equations standardized by CIELAB.

Following exposure, the examples were processed in the Kodak Ektacolor RA-4 Color Development Process™. The color development process and the compositions of the color developer and bleach-fix solutions are given in Table 2 below.

TABLE 2

Color Development Processing

| Process Step | Time (min.) | Temp.(°C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

TABLE 3

Color Developer Formulation

| | |
|---|---|
| Triethanolamine | 12.41 g/l |
| Phorwite REU ™ | 2.30 g |
| Lithium polystyrene sulfonate (30%) | 0.30 g |
| N,N-Diethylhydroxylamine (85%) | 5.40 g |
| Lithium sulfate | 2.70 g |
| Kodak Color Developer CD-3 | 5.00 g |
| 1-Hydroxyethyl-1 1-diphosphonic acid (60%) | 1.16 g |
| Potassium carbonate, anhydrous | 21.16 g |
| Potassium bicarbonate | 2.79 g |
| Potassium chloride | 1.60 g |
| Potassium bromide | 0.007 g |

pH adjusted to 10.4 at 26.7° C.

TABLE 4

Bleach-Fix Formulation

| | Per liter |
|---|---|
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetraacetate | 48.58 g |
| Ethylenediaminetetraacetic acid | 3.86 g |

pH adjusted to 6.7 at 26.7° C.

Color Gamut Analysis

Once the samples were prepared their respective color gamuts were determined. For ease of comparison, the chroma (C*) of the primary colors red, green and blue were determined.

To measure the color gamut, it is necessary to reproduce as many colors (combinations of a*, b* and L*) as possible at a range of lightnesses limited by the Dmin and Dmax of the element (in these examples, the reproduction of colors was intentionally limited to a lightness level which corresponded to a status A density of 2.0 so as to avoid conflicts with secondary color reproduction factors such as viewing flare, camera flare onto the film negative and printer flare.

Coating examples 1 to 21 from example 1 were prepared and their respective color saturations (C*) determined for the colors red, green and blue at a reproduced lightness of L*=50. To simplify the comparisons, the values of C* for each color were subsequently normalized to a value of 1.0 for comparative example 1. The results are given in Table 5.

TABLE 5

Results of Testing

| | Coupler | | | Relative C* @ L* = 50 | | | Total |
|---|---|---|---|---|---|---|---|
| Example | Cyan | Magenta | Yellow | Red | Green | Blue | C* |
| 1 Comp. | CC-1 | CM-1 | Y-1 | 1.00 | 1.00 | 1.00 | 3.00 |
| 2 Comp. | IC-7 | CM-1 | Y-1 | 0.99 | 1.19 | 1.13 | 3.31 |
| 3 Comp. | IC-7 | CM-1 | Y-2 | 1.00 | 1.29 | 1.13 | 3.42 |
| 4 Comp. | CC-1 | CM-1 | Y-2 | 1.01 | 1.13 | 1.00 | 3.24 |
| 5 Comp. | CC-1 | IM-1 | Y-2 | 1.00 | 1.10 | 1.11 | 3.21 |
| 6 Comp. | CC-1 | IM-1 | Y-1 | 0.99 | 1.00 | 1.08 | 3.07 |
| 7 Inven. | IC-7 | IM-1 | Y-1 | 1.00 | 1.19 | 1.18 | 3.37 |
| 8 Inven. | IC-7 | IM-1 | Y-2 | 0.98 | 1.35 | 1.18 | 3.51 |
| 9 Inven. | IC-7 | IM-1 | Y-3 | 0.99 | 1.33 | 1.18 | 3.50 |
| 10 Inven. | IC-7 | IM-2 | Y-1 | 1.08 | 1.19 | 1.21 | 3.48 |
| 11 Inven. | IC-7 | IM-2 | Y-2 | 1.07 | 1.33 | 1.21 | 3.61 |
| 12 Inven. | IC-7 | IM-3 | Y-2 | 1.11 | 1.31 | 1.21 | 3.63 |
| 13 Comp. | CC-2 | CM-1 | Y-1 | 1.05 | 1.13 | 1.13 | 3.31 |
| 14 Inven. | CC-2 | IM-1 | Y-2 | 1.05 | 1.15 | 1.18 | 3.38 |
| 15 Inven. | CC-2 | IM-2 | Y-2 | 1.12 | 1.15 | 1.21 | 3.48 |
| 16 Comp. | CC-3 | IM-2 | Y-2 | 1.08 | 1.04 | 1.24 | 3.36 |
| 17 Comp. | CC-4 | IM-2 | Y-2 | 1.08 | 0.92 | 1.16 | 3.16 |
| 18 Comp. | CC-5 | IM-2 | Y-2 | 1.02 | 0.71 | 0.84 | 2.57 |
| 19 Comp. | IC-7 | CM-2 | Y-2 | 0.94 | 1.25 | 1.13 | 3.42 |
| 20 Comp. | CC-6 | IM-2 | Y-2 | 1.05 | 1.13 | 1.03 | 3.21 |
| 21 Comp. | CC-1 | IM-2 | Y-4 | 1.04 | 1.04 | 1.11 | 3.19 |

Larger values of relative C* indicate increased color saturation and a larger color dye gamut.

Coupler combinations of the invention allow increased color saturation and a larger dye gamut. The total for the inventive combinations of couplers ranges from a low of 3.37 to 3.63 while the comparisons range from 3.0 to 3.42 with all but two below 3.37.

As is well known, the human eye is more sensitive to green light and blue light than to red. The relative C* of these values is greatly enhanced for the inventive coupler combinations versus the comparisons.

Combinations of the inventive cyan dye forming coupler with the magenta coupler of formula 3 are especially unique in the ability to increase the color saturation of the colors green and blue. Combinations of the inventive cyan dye forming coupler with the magenta coupler of formula 4 are especially unique in the ability to increase the color saturation of red, green and blue.

The inventive cyan coupler facilitates the increases in color saturation of green and blue when used in combination with the preferred magenta or yellow dye forming couplers of the invention.

EXAMPLE COMPARATIVE COUPLERS
CC-1
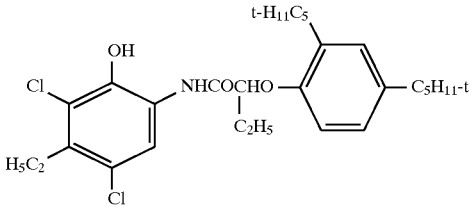
CC-2
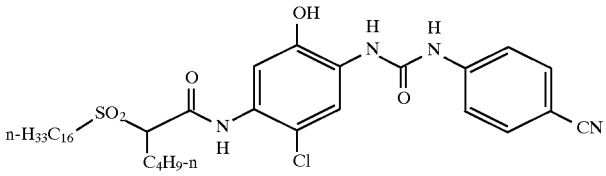
CC-3
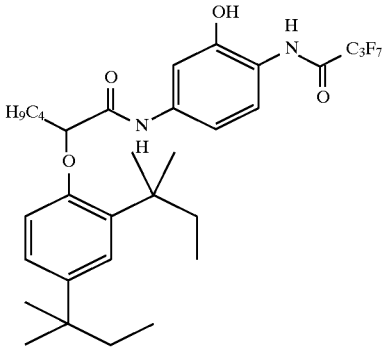
CC-4
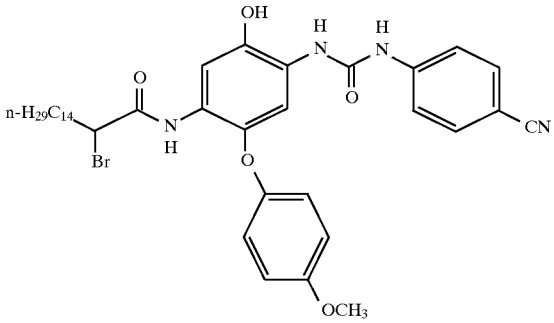
CC-5
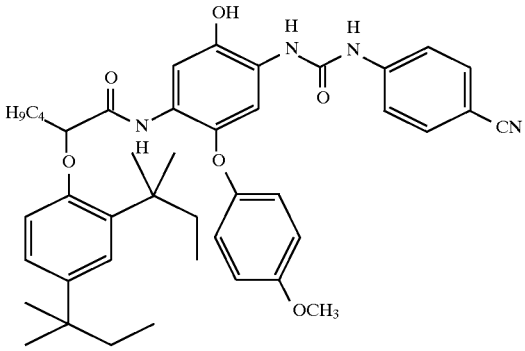

-continued
EXAMPLE COMPARATIVE COUPLERS
CC-6
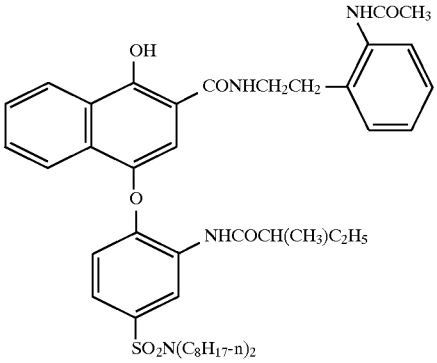
CM-1
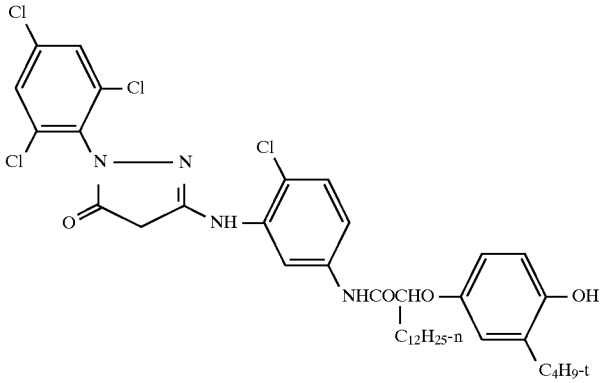
CM-2
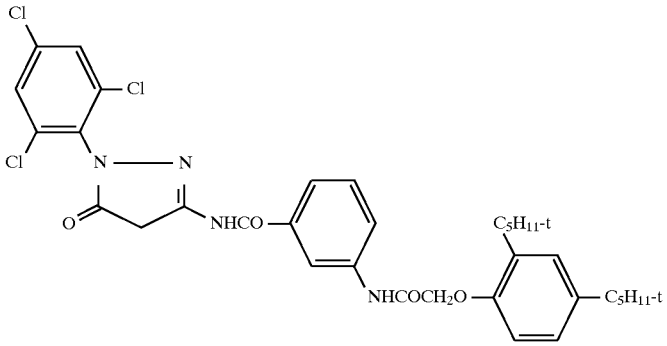
Y-1
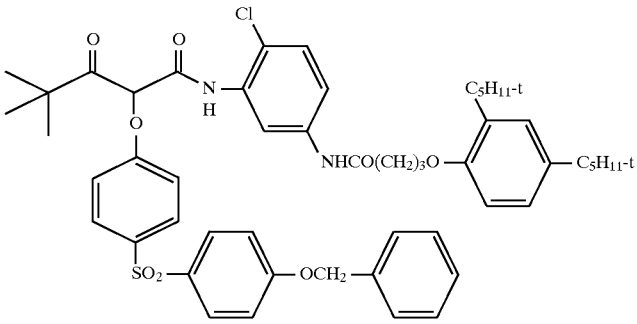

-continued
EXAMPLE COMPARATIVE COUPLERS
Y-2
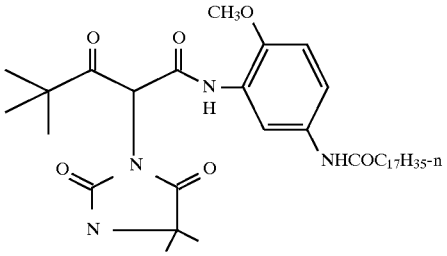
Y-3
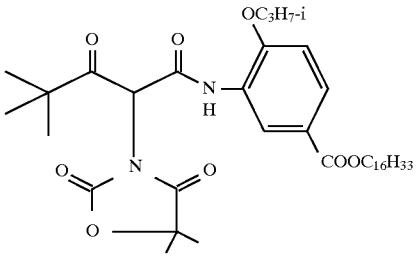
Y-4
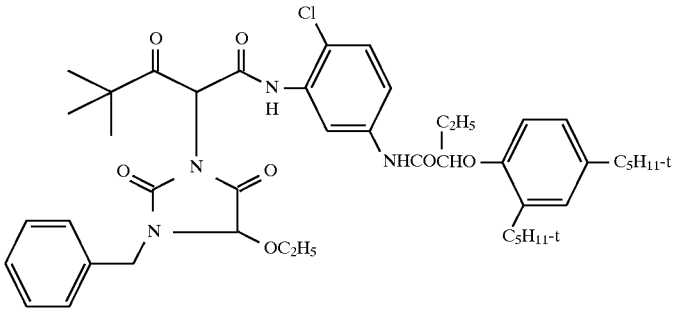
Compounds used in multilayer:
BSD-1
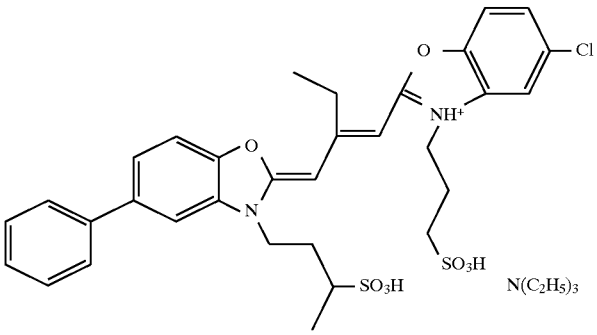
GSD-1
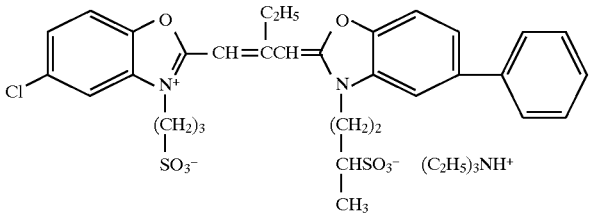

-continued

EXAMPLE COMPARATIVE COUPLERS

RSD-1

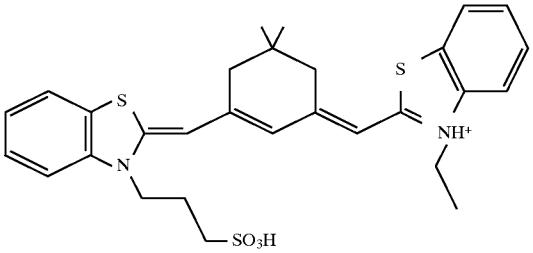

S-1

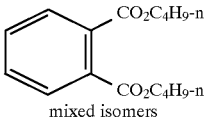

S-2

$CH_3(CH_2)_7CH{=}CH(CH_2)_8OH$

ST-1

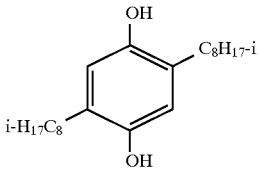

ST-2

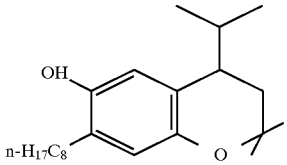

UV-1

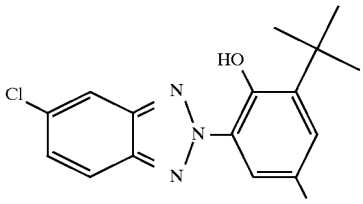

UV-2

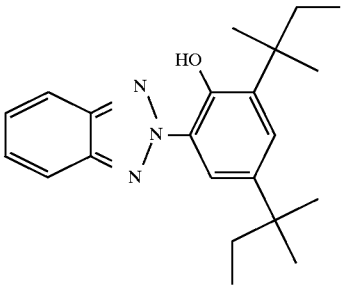

What is claimed is:

1. A photographic element comprising a red light sensitive silver halide emulsion layer having associated therewith a cyan dye forming coupler having Formula (I) and a green light sensitive silver halide emulsion layer having associated therewith a magenta dye forming coupler having formula IIA or IIB:

I

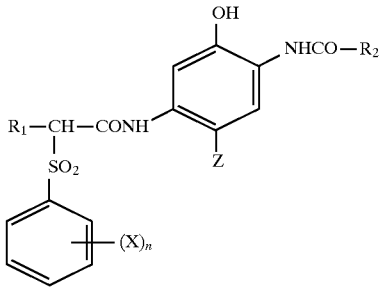

wherein $R_1$ represents hydrogen or an alkyl group selected from the group consisting of methyl, ethyl, n-propyl, isopropyl, and butyl groups;

$R_2$ represents an aryl group substituted by a substituent selected from the group consisting of cyano, halogen, carbonyl, alkoxy, aryloxy, oxysulfonyl, sulfoxide, thio, sulfamoyl, carboxy, sulfonamido, carbonamido, and carbamoyl groups;

n represents 1, 2, or 3;

each X is located at a position of the phenyl ring meta or para to the sulfonyl group and is independently selected from the group consisting of alkyl alkenyl, alkoxy, aryloxy, acyloxy, acylamino, sulfonyloxy, sulfamoylamino, sulfonamido, ureido, oxycarbonyl, oxycarbonylamino, and carbamoyl groups; and Z represents a hydrogen atom or a group which can be split off by the reaction of the coupler with an oxidized color developing agent; and

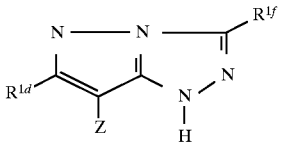

IIA

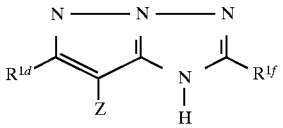

IIB wherein Z represents hydrogen or a coupling-off group bonded to the coupling site; and $R^{1d}$ and $R^{1f}$ represent a hydrogen atom, or a substituent group.

2. The element of claim 1 additionally comprising a blue light sensitive silver halide emulsion layer having associated therewith a yellow dye forming coupler having formula III:

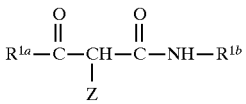

III wherein Z represents hydrogen or a coupling-off group, $R^{1a}$ represents an aliphatic hydrocarbon group, and $R^{1b}$ represents an aryl group.

3. The element of claim 2 wherein the $R^{1b}$ substituent is a phenyl group having an alkoxy or halogen substituent in the position ortho to the anilide nitrogen.

4. The element of claim 3 wherein the ortho substituent is an alkoxy group.

5. The element of claim 1 wherein $R_1$ is hydrogen.

6. The element of claim 1 wherein $R_2$ is a phenyl group.

7. The element of claim 6 wherein $R_2$ is selected from the group consisting of a 4-chlorophenyl, 3,4-dichlorophenyl, 4-cyanophenyl, 3-chloro-4-cyanophenyl, pentafluorophenyl, 4-carbonamidophenyl, and a 4-sulfonamidophenyl.

8. The element of claim 1 wherein at least one X is an alkyl or alkoxy group.

9. The element of claim 1 wherein at least one X is selected from the group consisting of alkyl, alkoxy, carboxy, sulfonamido, and halogen.

10. The element of claim 1 wherein Z in Formula I is hydrogen.

11. The element of claim 1 wherein Z in Formula I is is halogen.

12. The element of claim 1 containing a magenta coupler of formula IIA.

13. The element of claim 1 containing a magenta coupler of formula IIB.

14. The element of claim 1 which is adapted for direct viewing.

15. The element of claim 14 wherein the element contains a reflective paper support.

16. The element of claim 1 wherein the element contains a transparent support and is suitable for projection viewing.

17. A process for forming an image in an element as described in claim 1 after the element has been imagewise exposed to light comprising contact the element with a color developing compound.

18. The element of claim 1 wherein $R_1$ is selected from the group consisting of methyl, ethyl, n-propyl, and isopropyl.

19. The element of claim 1 wherein $R_2$ represents an aryl group substituted with a substituent selected from the group consisting of halogen, cyano, and sulfonamido.

20. The element of claim 1 wherein an X contains from 8 to 20 linear carbon atoms.

21. The element of claim 15 wherein said X contains a linear alkyl group of 12 to 18 carbon atoms.

22. The element of claim 1 wherein an X is an alkoxy group.

23. The element of claim 18 wherein said X is at a position of the phenyl ring para to the sulfonyl group.

24. The element of claim 19 wherein said X contains 8–20 linear carbon atoms.

* * * * *